United States Patent [19]

De Weck

[11] 4,441,445

[45] Apr. 10, 1984

[54] SELF-RIGHTING MULTIHULL BOAT

[76] Inventor: Roger De Weck, CH-1723 Villars-sur Marly, Switzerland

[21] Appl. No.: 322,199

[22] Filed: Nov. 17, 1981

[30] Foreign Application Priority Data

Nov. 24, 1980 [CH] Switzerland ..... 8671/80

[51] Int. Cl.[3] ..... B63B 35/36

[52] U.S. Cl. ..... 114/39; 114/61; 114/123; 114/125

[58] Field of Search ..... 114/39, 61, 123, 292, 114/125, 283, 121

[56] References Cited

U.S. PATENT DOCUMENTS

| | | | |
|---|---|---|---|
| 1,709,219 | 4/1929 | Hille | 114/123 |
| 3,099,912 | 8/1963 | Wolff | 114/123 |
| 3,137,263 | 6/1964 | Sainte-Claire | 114/125 |
| 3,541,987 | 11/1970 | Barkley | 114/61 |
| 3,981,259 | 9/1976 | Harper | 114/123 |
| 4,159,006 | 6/1979 | Thurston | 114/123 |
| 4,207,828 | 6/1980 | Horowitz et al. | 114/125 |
| 4,223,621 | 9/1980 | Berger | 114/61 |
| 4,297,961 | 11/1981 | Johnson | 114/123 |

FOREIGN PATENT DOCUMENTS 581557 11/1976 Switzerland .

*Primary Examiner*—Trygve M. Blix
*Assistant Examiner*—Stephen P. Avila
*Attorney, Agent, or Firm*—Laubscher, Philpitt & Laubscher

[57] ABSTRACT

The trimaran has a lateral hull which is fixed at the end of a beam rotatably mounted on a longitudinal axis, which itself is supported by an outrigger protruding from the central hull. A jack allows the lateral hull to rotate around the axis (arrow). Openings are provided in the lateral hull, in order to fill and flush it. The catamaran can be righted from the capsized position by a rotation of the water-filled side hulls through about 90°, because the side hulls then act as ballasted keels. After emptying the lateral hulls and returning the beams to their normal position, navigation may be resumed.

9 Claims, 7 Drawing Figures

Fig. 5
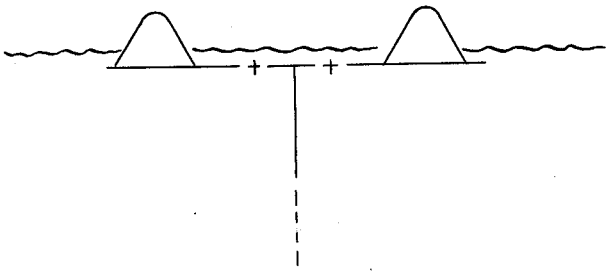
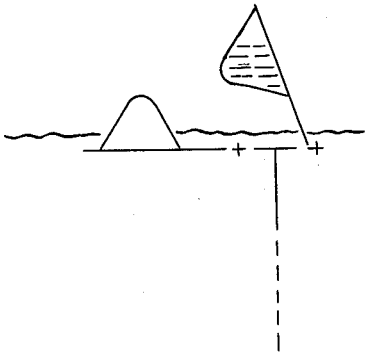
Fig 6
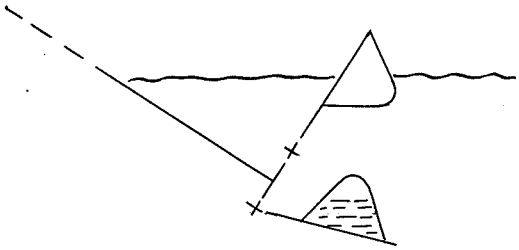
Fig. 7

SELF-RIGHTING MULTIHULL BOAT

BACKGROUND OF THE INVENTION

Field of the Invention

The invention relates to multihull boats, in particular sailing crafts. The advantages of such crafts are well-known, but the practical impossibility to righten them again after a capsize, especially in open waters, is a serious drawback. To a certain extent, this impossibility may be admitted during races, but it is always prohibitive in open water cruising. Now the lightness of modern crafts, which is a primary condition for taking full advantage of the possibilities of multihull constructions, increases notably the risk of capsizing, be it laterally, over the bow, or even over the stern as has reportedly happened.

SUMMARY OF THE INVENTION

Hence, it is a general object of the present invention to provide a self-righting multihull craft. The invention does also allow to prevent a capsize and, incidentally, to save room in crowded anchorages and harbors.

In order to implement these and still further objects of the invention, the multihull boat of the invention is characterized by at least one articulation joining at least one of its hulls to the remainder of the craft, so as to permit a rotational movement of said hull around an axis oriented in the longitudinal direction of the craft, by means for at least partially filling said hull with water, and thereafter draining the same even when said hull is submerged, and by means for creating a moment which will induce a rotation of said hull around said axis.

This allows one or several hulls to be filled and rotated into a position akin to that of the keel of a keel boat. Thus, the craft will be righted after a capsize, and maintained in a statically stable position, the ballasted hull pointing downwards and the mast upwards, as long as necessary.

BRIEF DESCRIPTION OF THE DRAWINGS

FIGS. 5 to 7 illustrate the corresponding steps for righting a catamaran.

DETAILED DESCRIPTION OF PREFERRED EMBODIMENTS

Figure 1:
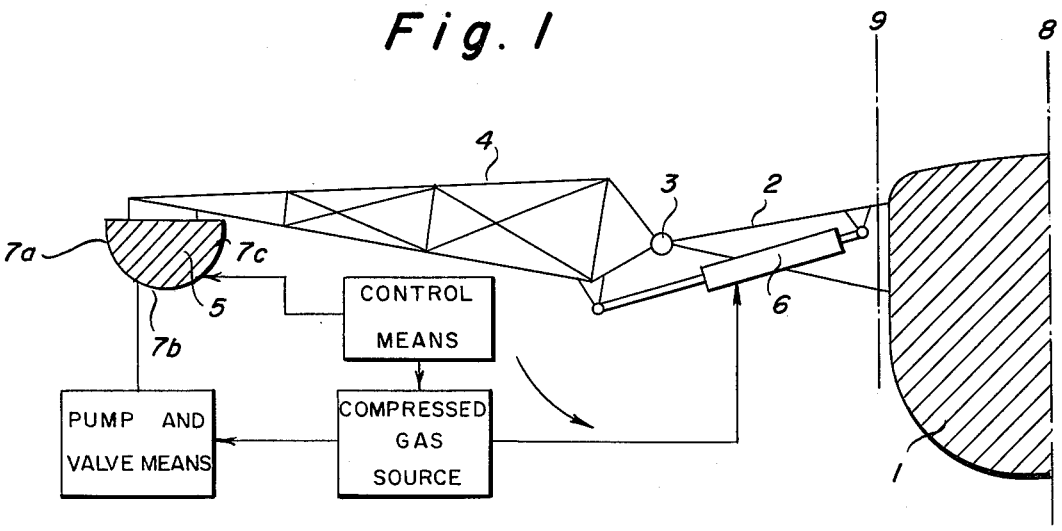
FIG. 1 schematically represents a transversal section of two embodiments (according to whether or not one ignores the hull 1)

FIG. 1 schematically shows one-half of a transversal section through an embodiment of the invention, when applied to a trimaran the lateral symmetry plane of which is labelled 8. The main hull 1 of this trimaran carries on each side an outrigger 2 ending in an articulation 3, to which is fixed a lateral beam 4, which itself carries a side hull 5. The articulation 3 is so arranged, that the beam can turn, relatively to the main hull 1, around an axis which is essentially parallel to the longitudinal axis of the trimaran, that is, normal to the plane of the drawing. This rotation takes place downwardly, that is, outwardly about the articulation axis through an angle the major portion of which lies below a horizontal plane drawn through the axis toward the bottom of the main hull as shown by the arrow, starting from the normal position for navigation shown in FIG. 1. One end of a mechanical or hydraulic jack 6 is fixed to the outrigger, and its other end to the beam, in a way which allows the jack to exert the force necessary for the rotation. Means (not shown) are provided for filling the side hull 5 with water, and also for draining it, if necessary against a certain external hydrostatic pressure, which will exist when the hull is submerged below the sea level. Some openings *7a,b,c* are sketched in FIG. 1, in order to indicate the existence of the valves and air vents necessary for these operations; obviously the opening and closing of these apertures must be either automatic, or remotely commanded, for example from the main hull 1. By the same token the pumps and/or reservoirs of compressed gas used for draining the water from the hull must naturally be constructed so as to function safely under the difficult conditions which generally accompany any capsize. Furthermore, it can be advantageous to provide filling and draining means for the hull, which do not necessarily perform these operations to the very end, but do allow for performing these operations gradually, and also for interrupting them in accordance with surrounding conditions, especially the state of the sea and the actual orientation of the craft around its longitudinal axis.

An adequate arrangement for a catamaran will be obtained by deleting the central hull of FIG. 1, and by imagining that the remainder of the figure has a symmetry axis in 9. The former outrigger 2 will then be integral with a symmetrical piece, both together forming the central platform of the catamaran, on which the mast is fixed. The shrouds which stay the mast will always be fixed to non-articulated parts, that is in general onto the outriggers, whether these form a central platform or not. It is always possible to provide the articulation 3 only on one side of the craft, a simplification which is mainly adequate for catamarans and proas, as shown on FIGS. 5 through 7 (which are described below) where only rotation around one articulation is used for righting the craft. The rig may then be stayed on the rigid part of the craft, including the non-articulated beam or beams, and it is only necessary to provide the side hull fixed to a rotatable beam with means for filling and flushing it.

Figure 2:
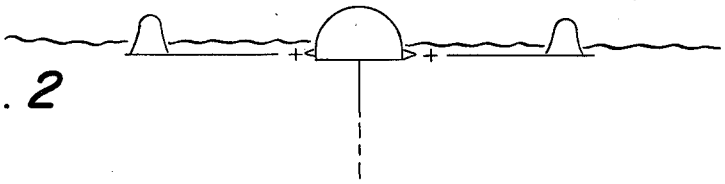
FIGS. 2 to 4 illustrate the different steps when righting a trimaran.

The righting will now be described with reference to FIGS. 2 through 4 for a trimaran, and 5 through 7 for a catamaran or a proa. The FIGS. 2 and 5 show capsized crafts in an upturned, stable position, with the mast pointing downwards. For righting the craft, one or two side hulls are first rotated upwardly by the action of jacks 6 and then filled with water, thus reaching the position shown in FIGS. 3 and 6. This position obviously is unstable and leads to a turning-over motion, which will end in the position shown in FIGS. 4 and 7, respectively.

Figure 3:
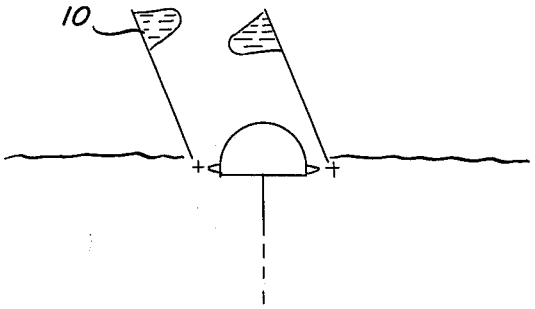
Figure 4:
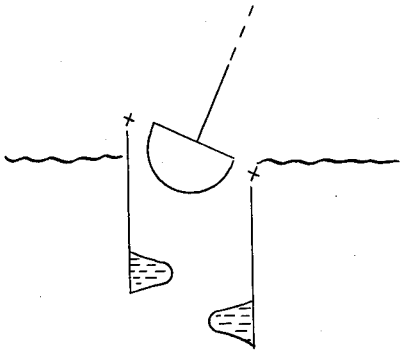

It must be remarked, that the position of FIGS. 3 and 6 may also be reached by first opening the valves and vents of the hull or hulls, when in a capsized position, as shown in FIGS. 2 and 5, and thereafter raising the beams upwardly, after the valves and vents have been closed. Which method is used will depend on the relative power of the jacks and the pumping means.

In particular the hull 10 of FIG. 3 can be filled before it is rotated upwardly, which simplifies the pumping actions. The angle of the beams with respect to the mast in FIG. 3 is also not really necessary, considering that the wind and sea conditions prevailing after a capsize will ensure that even if the beams were exactly parallel to the mast, this position would be unstable too, once the hulls are filled with water. FIGS. 4 and 7 illustrate the stable position obtained after the turn-over provoked by the ballast within the uprised hull, or hulls. The trimaran of FIG. 4 can reach a totally upright position by orienting its beams parallel to the mast. One can then remain in this position, which is stable in spite of the comparatively small ballast, until the sea is sufficiently calmed down, or one can drain the hulls, while simultaneously rotating them back into the normal position for navigation. To this end it is incidentally sufficient to drain the hulls, which will rise to the surface by themselves, so that the jacks need not be operated.

Furthermore, the position with filled hulls oriented downwards, in a position essentially below the main hull, can also be taken as a precaution, when the conditions of wind and sea make this advisable. This position is also useful in a crowded harbour or anchorage whenever these have sufficient depths.

The righting of the catamaran of FIG. 7 is a more delicate operation, which may even require a good synchronisation between the draining of the submerged hull, and the rotation in direction of the arrow, which will put it back into its normal position for navigation. The rotation must be comparatively swift, in order to take advantage of the very great lateral resistance of the rig in the water, so as to obtain a positive moment which is sufficient to initiate the righting-up, before the mast points downwards. In order to guarantee this, it can be useful to start emptying the submerged hull at the very beginning of the rotation, or even slightly in advance; in certain cases automatically commanding these operations can be a great advantage.

In general the necessary operations may be performed by hand, or by simple mechanical means on small sporting crafts. These may also be realized in many different and occasionally sophisticated ways on larger ships. The necessary energy can be provided either by a source of compressed air or nitrogen, or else by a hand pump, or also by an electrical motor fed from watertight batteries. These means can be complemented by a thermal engine hung on gimbals and otherwise doing duty as a general purpose auxiliary. The use of compressed gas cartridges is also possible.

If necessary it must be possible to command the operations (opening the valves and vents, closing them, actuating the jacks, pumping out after righting, rotating the beams) manually, essentially by opening and closing valves. The sequence of operations can also be initiated automatically, by a pendulum, by inertial action of a mass, or for instance by an enclosed mercury contact sensitive to its orientation within space, to cite only a few possibilities.

The energy sources and main controls which will be enclosed in the central hull, within a reinforced watertight cell, should be accessible both from within the hull and through a watertight trapdoor, which opens at or below the waterline, and can be opened from outside. Already now such a trapdoor is compulsory for trimarans intended for navigation on the open sea. The side hulls can also have a longitudinal bulkhead which limits the amount to which they can be filled. On the other hand, the weight of the lateral hull can also be increased by center boards or by foils.

What is claimed is:

1. A multihull boat, comprising
(a) a main body portion (1) having a normal upright position relative to a body of water;
(b) at least one side hull member (5);
(c) articulation means (3) pivotally connecting said side hull member with said main body portion for pivotal movement about a horizontal pivot axis parallel with the longitudinal axis of said main body portion, said side hull member normally having a first position at water level when said main body portion is in its upright position;
(d) means (*7a, 7b, 7c*) for filling and draining said side hull member with water; and
(e) means (6) for pivoting said side hull member downwardly about said articulation pivot axis relative to said main body portion when the boat is in its normal upright position to a second position below said main body portion, thereby to create a moment for inducing rotation of said main body portion about the longitudinal axis thereof after the boat has been capsized by more than 90°.

2. Apparatus as defined in claim 1, wherein said means for filling said side hull member further comprises pumping means for pumping water into said side hull and valve means for releasing water from said side hull.

3. Apparatus as defined in claim 2, wherein said means for pivoting said side hull member comprises at least one jack, said jack having sufficient power to raise said partially filled side hull above the water when said main body portion is inverted relative to its normal upright position.

4. Apparatus as defined in claim 3, wherein said side hull member is pivoted through an angle of at least 70°.

5. Apparatus as defined in claim 4, wherein said side hull member is pivoted through an angle greater than 90°.

6. Apparatus as defined in claim 1, wherein said main body portion comprises a first hull member having a longitudinal plane of symmetry, and further wherein said at least one side hull member comprises a pair of side hull members pivotally connected with opposite sides of said first hull member for pivotal movement about horizontal pivot axes symmetrically arranged on opposite sides of said longitudinal plane, respectively.

7. Apparatus as defined in claim 6, and further comprising a pair of outriggers connected with and extending from opposite sides of said first hull member, said pivot axes being arranged on said outriggers, respectively.

8. Apparatus as defined in claim 3, and further comprising control means for controlling the operation of said pump means, said valve means, and said jack means for creating said moment.

9. Apparatus as defined in claim 3, and further comprising a source of compressed gas for driving said pump means, said valve means, and said jack means.

* * * * *